United States Patent [19]

Takei et al.

[11] Patent Number: 4,538,958

[45] Date of Patent: Sep. 3, 1985

[54] FUEL PUMP HAVING REGENERATIVE SECTION PROVIDED WITH VENT HOUSING FOR VOLTEX FLOW

[75] Inventors: Toshihiro Takei, Kariya; Yoshiyuki Hattori, Toyoake; Shunsaku Ohnishi, Toyota, all of Japan

[73] Assignee: Nippondenso Co., Ltd., Kariya, Japan

[21] Appl. No.: 575,389

[22] Filed: Jan. 30, 1984

[30] Foreign Application Priority Data

Jan. 31, 1983 [JP] Japan ..... 58-14462

[51] Int. Cl.[3] ..... F04D 5/00

[52] U.S. Cl. ..... 415/53 T; 415/168

[58] Field of Search ..... 415/53 R, 53 T, 121, 415/168, 213 T; 417/366, 423 R

[56] References Cited

U.S. PATENT DOCUMENTS 2,815,717 12/1957 Szwargulski et al. ..... 415/168 X
3,418,991 12/1968 Shultz et al. ..... 417/423 R X
3,881,839 5/1975 MacManus ..... 415/168 X
4,408,952 10/1983 Schweinfurter ..... 415/213 T X

FOREIGN PATENT DOCUMENTS 30968 10/1960 Finland ..... 415/213 T

*Primary Examiner*—Robert E. Garrett
*Assistant Examiner*—Joseph M. Pitko
*Attorney, Agent, or Firm*—Cushman, Darby & Cushman

[57] ABSTRACT

A fuel pump comprises a regenerative pump section, a driving section and a housing, the regenerative pump section being provided with a vapor vent for discharging fuel vapor. The vapor vent communicates with an outside of the fuel pump through a vent housing for a vortex flow. The vent housing has a vent chamber, a tangential groove and a discharge hole. A vortex flow of the fuel including the fuel vapor generates in the vent chamber and flows from the tangential groove to the discharge hole. When the fuel vapor does not generate, the vortex phenomenon is enhanced so that an amount of the fuel discharged from the discharge hole is reduced. The vent housing may have a radial control groove communicating with a control hole in addition to the tangential groove.

5 Claims, 11 Drawing Figures

FUEL PUMP HAVING REGENERATIVE SECTION PROVIDED WITH VENT HOUSING FOR VOLTEX FLOW

BACKGROUND OF THE INVENTION (1) Field of the Invention

This invention relates to a fuel pump used for an automobile or the like, and more specifically to an improvement of a fuel pump driven by an electric motor, supplying fuel to an injector at a high pressure, and constituting a part of means for injecting fuel to an engine in response to signals from an electronic control device.

(2) Description of the Prior Art

A displacement pump has been hitherto mainly used for feeding fuel with a high pressure, a discharge pressure of the pump being about 2 or 3 kg/cm$^2$. The displacement pump, however, has disadvantages that high accuracy of working is required for obtaining a desired performance, thus resulting in a high cost, and the discharge pressure greatly pulsates due to the displacement type, thus resulting in high vibration and noise.

It has been known for solving the aforesaid disadvantages to use a regenerative pump as a fuel pump. The regenerative pump used as the fuel pump is described in, for example, U.S. patent application Ser. Nos. 362,855 filed on Mar. 29, 1982, now U.S. Pat. No. 4,451,213; 366,688 on Apr. 8, 1982, now abandoned; 377,546 on May 12, 1982; 369,426 on Apr. 19, 1982; 370,350 on Apr. 21, 1982, now U.S. Pat. No. 4,478,550; 372,169 on Apr. 26, 1982, now U.S. Pat. No. 4,445,821; 372,377 on Apr. 27, 1982, now U.S. Pat. No. 4,403,910; 378,724 on May 17, 1982; 405,579 on Aug. 5, 1982; 445,222 on Nov. 29, 1982 and 505,849 on June 20, 1983.

When an automobile runs under a severe load condition such as running on a sloping road in high ground and in a high temperature, a fuel temperature in a fuel tank rises gradually, thus often resulting in occurrence of bubbles of fuel vapor in the fuel tank. Then, the fuel pump sucks not only fuel but also the bubbles through a suction port, or sucks only the fuel vapor in an extreme state, so that a rise in fuel pressure is not performed in the fuel pump. As a result, a vapor-lock phenomenon occurs and an engine stops.

It has been known to provide the regenerative pump with a vapor vent midway of a pump passage in order to discharge the above-mentioned fuel vapor out of the fuel pump. The regenerative pump of this type can discharge vapor in a pump chamber during a starting operation of the pump, and further discharge vapor caused by cavitation during a normal operation of the pump. The conventional vapor vent, however, only connects the pump passage with the outside of the pump, thus it is inevitable that not a small amount of the fuel is discharged to the outside of the pump through the vapor vent even in case of including no fuel vapor. The fuel pump provided with the vapor vent is disclosed in, for example, U.S. Pat. No. 3,418,991.

SUMMARY OF THE INVENTION

An object of the invention is to provide a regenerative fuel pump capable of discharging the fuel vapor out of the pump, preventing the vapor-lock, and reducing the fuel discharged through the vapor vent to the outside of the pump when the fuel vapor is not generated.

To accomplish the aforesaid object, there is provided a fuel pump comprising a regenerative pump section, a driving section connected to an impeller of the regenerative pump section, and a housing enclosing the regenerative pump section and the driving section, the fuel pump being provided with a vapor vent midway of a pump passage extending from a suction port of the regenerative pump section to a discharge port thereof, wherein the vapor vent communicates with an outside of the fuel pump through a vent housing for a vortex flow, and the vent housing has a vent chamber of a substantially circular shape, a tangential groove provided with one end communicating with the vent chamber in a tangential direction to the vent chamber and other end communicating with the vapor vent, and a discharge hole provided with one end communicating with a center portion of the vent chamber and other end communicating with the outside of the fuel pump.

Another feature of the invention is to provide a fuel pump wherein the regenerative pump section is provided with a control hole communicating with the pump passage and disposed at a downstream side of the vapor vent, and the vapor vent and the control hole communicate with the outside of the fuel pump through a vent housing. The vent housing has a vent chamber of a substantially circular shape, a tangential groove provided with one end communicating with the vent chamber in a tangential direction to the vent chamber and other end communicating with the control hole, a vent groove provided with one end communicating with the vent chamber in a radial direction to the vent chamber and other end communicating with the vapor vent, and a discharge hole provided with one end communicating with a center portion of the vent chamber and other end communicating with the outside of the fuel pump.

The above and other features of the invention will become apparent from a reading of the detailed description of the preferred embodiments which make reference to the following set of drawings.

DETAILED DESCRIPTION OF THE PREFERRED EMBODIMENT

Figure 1:
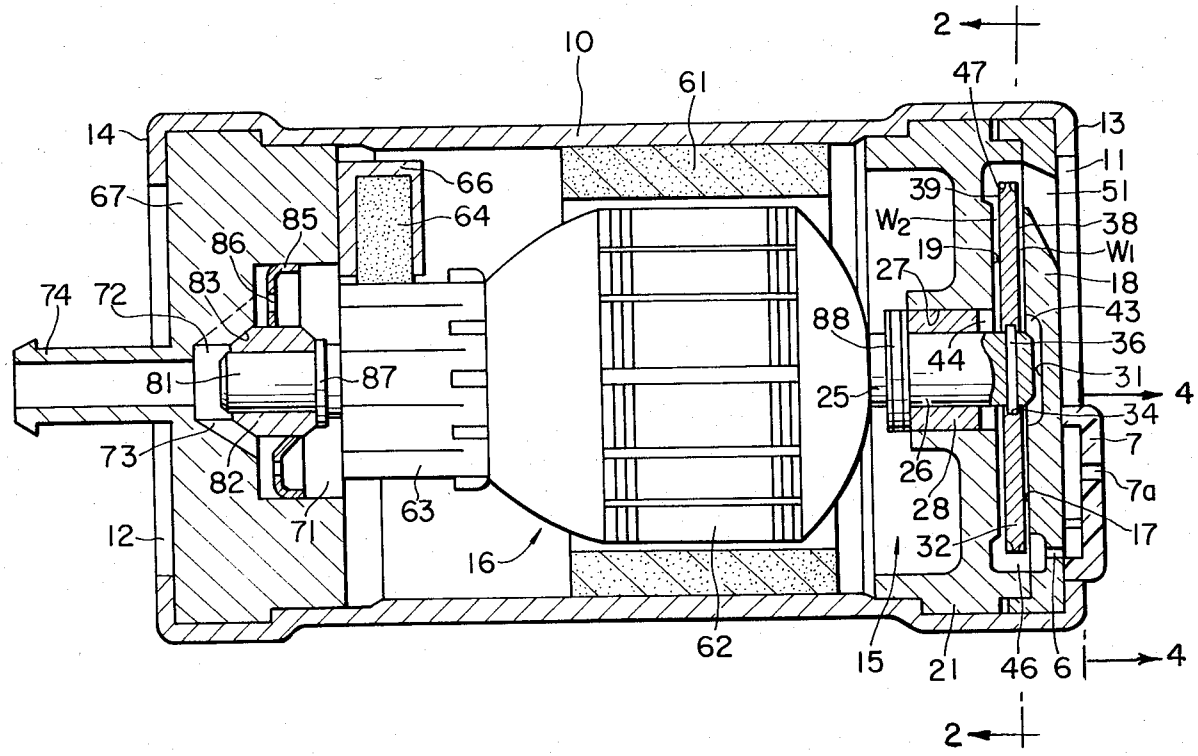
FIG. 1 is a cross-sectional view, taken along a plane including an axis of a fuel pump, of one embodiment of the invention.

Referring to FIG. 1, a fuel pump of this type is installed in liquid fuel in a fuel tank as of a vehicle. The fuel pump includes a substantially cylindrical housing 10, and the housing 10 has one axial end wall 13 and another axial end wall 14 each provided with an opening 11, 12. The fuel pump comprises a regenerative pump section 15 disposed in the housing 10 and being in contact with the end wall 13, and an driving section or electric motor section 16 disposed in the housing 10 and arranged adjacent to the regenerative pump section 15. The electric motor section 16 is connected to the regenerative pump section 15 and drives the same.

The regenerative pump section 15 includes a pump casing consisting of a first casing portion 18 and a second casing portion 21, the first casing portion 18 substantially closing the opening 11 provided on the end wall 13, and the second casing portion 21 having an inner surface 19. The inner surface 19 of the second casing portion 21 and inner surface 17 of the first casing portion 18 define a pump chamber.

A rotary shaft 25 extends coaxially with the housing 10 and is rotatably supported at its axial end 26 by a bearing 28 fitted into an axial central bore 27 provided on the second casing portion. The axial end 26 of the rotary shaft 25 passes through the pump chamber and has an axial end surface located in a central recess 31 formed on the inner surface 17 of the first casing portion 18.

A disc-shaped impeller 32 is rotatably mounted on the rotary shaft 25 in the pump chamber. The impeller 32 has an axial central bore 33 (see FIG. 2) adapted to be fitted over the one axial end 26 of the rotary shaft 25. A wall surface of the central bore 33 is formed with a pair of axial grooves 34 diametrically opposed to each other. A pin 36 having a circular cross-section extends through the axial end 26 of the rotary shaft 25, and two ends fitted into the pair of axial grooves 34 respectively. Accordingly, the impeller 32 is so mounted on the rotary shaft as to be movable in an axial direction and not rotatable with respect to the rotary shaft 25.

The impeller has one axial end surface 38 facing the inner surface 17 of the first casing portion 18 and defining a first gap $W_1$, and the other axial end surface 39 facing the inner surface 19 of the second casing portion 21 and defining a second gap $W_2$. These gaps $W_1$ and $W_2$ are actually very small, and exaggerated in FIG. 1 therefore.

The central recess 31 provided on the first casing portion 18 defines a chamber 43 by cooperating with the end surface and a peripheral surface of the axial end portion 26. The axial central bore 27 provided on the second casing portion 21 defines a chamber 44 by cooperating with an axial end surface of the bearing 28 and the peripheral surface of the axial end portion 26 of the rotary shaft 25. As can clearly be seen in FIG. 2, the wall surface of the axial central bore 33 provided on the impeller 32 is formed with a second pair of axial grooves 45 diametrically opposed to each other. The chambers 43 and 44 communicate with each other through the second pair of axial grooves 45, so that the pressure balance can effect between the chambers 43 and 44.

Figure 2:
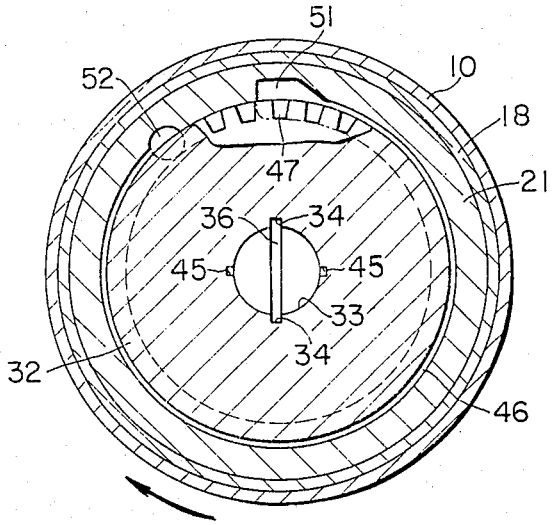
FIG. 2 is a view, mainly in section, taken on line 2—2 of FIG. 1.

The impeller 32 has a peripheral portion defining a substantially annular pump passage 46 in the casings 18 and 21. The peripheral portion of the impeller 32 is formed with a plurality of radial blade grooves 47 arranged circumferentially with equally spaced relations. The impeller 32 shown in FIGS. 1 and 2 is of a closed-blade type, that is, bottom surfaces of the blade grooves 47 formed on one axial end surface 38 do not intersect with the other axial end surface 39, while bottom surfaces of the blades 47 formed on the other axial end surface 39 also do not intersect with the one axial end surface 38.

The pump passage 46 communicates with the liquid fuel in the fuel tank (not shown) through a suction port 51 provided on the first casing portion 18, and also communicates with a space within the housing 10 through a discharge port 52 provided on the second casing portion 21.

The electric motor section 16 has two substantially arcuate permanent magnets 61 arranged coaxially with the rotary shaft 25 in the housing, an armature 62 fixedly mounted on the rotary shaft 25 and arranged coaxially with the permanent magnets 61, and a commutator 63 connected to the armature 62 and secured to the rotary shaft 25. The commutator 63 is in sliding contact with a brush 64 supported by a brush holder 66 secured to an end block 67. The end block 67 is arranged to substantially close the opening 12 of the housing 10. The end block 67 has a central recess 71 formed on its axial end surface facing the space in the housing, and a second central recess 72 formed on a bottom surface of the central recess 71. A wall surface of the second central recess 72 is formed with a plurality of grooves 73 arranged circumferentially with spaced relations. The grooves 73 each has an inclined bottom surface and an end which opens to a bottom surface of the second central recess 72. The end block 67 has a hollow projection 74 projecting outwardly from the other axial end surface, and a bore of the hollow projection 74 communicates with the second central recess 72. The hollow projection 74 is adapted to communicate with a fuel consumption system such as an engine (not shown).

The other axial end portion 81 of the rotary shaft 25 is rotatably supported by a bearing 82. The bearing 82 is seated on a seat 83 formed by chamfering on the second central recess 72, and held in place by an annular retainer 85 disposed in the central recess 71. The retainer 85 has a plurality of holes 86 formed circumferentially with spaced relations. The rotary shaft 25 is held in place by the annular retainer 85. The rotary shaft 25 is held also axially in place by a spacer 87 mounted on the rotary shaft 25 and being in contact with one axial end surface of the bearing 82, and by a spacer 88 mounted on the rotary shaft 25 and being in contact with one axial end surface of the bearing 28.

Figure 3:
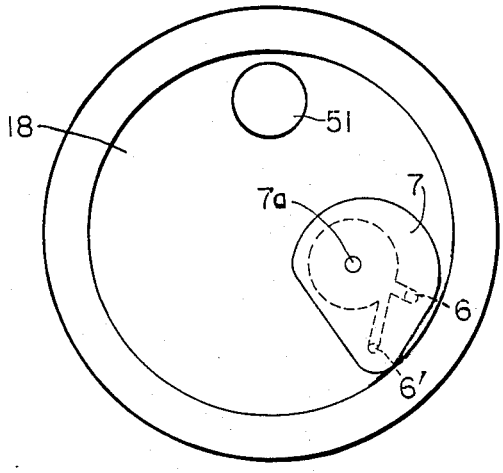
FIG. 3 is an end view of the embodiment shown in FIG. 1 taken from the right hand end thereof.

Referring to FIG. 3, there are clearly shown the first casing portion 18 and a vent housing 7. The first casing portion 18 is provided with a vapor vent 6 at a somewhat upstream side of the half point of the pump passage 46 extending from the suction port 51 to the discharge port 52, and further provided with a control hole 6′ at a downstream side of the vapor vent 6. A diameter of the control hole 6′ is smaller than that of the vapor vent 6. The vent housing 7 is secured, by adhesion, caulking or the like, to an opening side of the first casing portion 18. The vent housing is integrally made by resin molding, aluminium die casting or the like.

Figure 4:
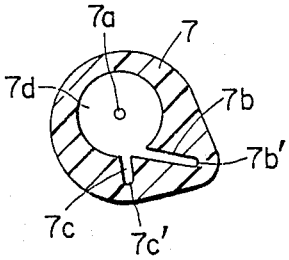
FIG. 4 is a view of the vent housing shown in FIG. 3, taken on line 4—4 of FIG. 1.

Referring to FIG. 4, the vent housing 7 has a vent chamber *7d*, a discharge hole *7a*, a tangential groove *7b* and a vent groove *7c*. The vent chamber *7d* is a substantially circular recess. The discharge hole *7a* has one end communicating with a central portion of the vent chamber *7d* and other end communicating with the outside of the fuel pump. The tangential groove *7b* has one end communicating with the vent chamber *7d* in a tangential direction to the vent chamber *7d* and other end *7b′* communicating with the control hole 6' provided on the first casing portion 18. The vent groove 7c has one end communicating with the vent chamber 7d in a radial direction to the vent chamber 7d and other end 7c' communicating with the vapor vent 6 provided on the first casing portion 18.

An operation of the fuel pump of the above construction will be described hereinunder.

When an electric current is introduced from the electric source (not shown) to the brush 64, the armature 62 rotates. The rotation of the armature 62 is transmitted to the impeller 32 through the rotary shaft 25, and the impeller 32 rotates in the clockwise direction as shown by an arrow in FIG. 2. The rotation of the impeller 32 allows the liquid fuel in the fuel tank to be introduced to the pump passage 46 through the suction port 51. The fuel introduced to the pump passage 46 is increased in pressure by the action of the blade grooves 47 of the impeller 32, and is discharged to the space in the housing 10 through the discharge port 52, and is further conducted to the fuel consumption system through an annular gap defined between the permanent magnets 61 and the armature 62, the holes 86 formed on the retainer 85, the grooves 73 formed on the end block 67 and the bore of the hollow projection 74.

Figure 5:
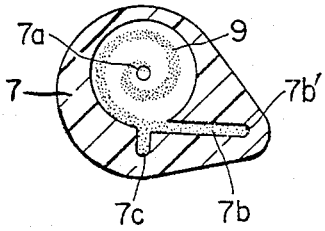
FIGS. 5 and 6 are views like FIG. 4, showing an operational principle of the invention.
Figure 6:
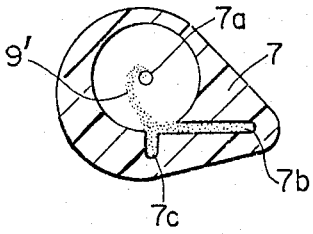

Nextly, an operational principle of the vent housing for a vortex flow will be explained by referring to FIGS. 5 and 6. During the normal running of the vehicle wherein the fuel is not vaporized, the fuel in the pump passage 46 partly discharged from both vapor vent 6 and the control hole 6'. As shown in FIG. 5, the fuel discharged from the control hole 6', which is located at a higher pressure side than the vapor vent 6, constitutes a control flow flowing from the tangential groove 7b into the vent chamber 7d in the tangential direction with respect to the vent chamber 7d. On the other hand, the fuel discharged from the vapor vent 6 constitutes a main flow flowing from the vent groove 7c into the vent chamber 7d in the radial direction with respect to the vent chamber 7d. The main flow has a larger flow rate than that of the control flow because the control hole 6' has a smaller diameter than that of the vapor vent. The control flow has a higher speed than that of the main flow because the control hole 6' is located at a higher pressure side, i.e. downstream side, than the vapor vent. In this condition, the main flow from the vent groove 7c is altered in direction by the action of the control flow from the tangential groove 7b and becomes a vortex flow 9. The more the vortex flow approaches the center of the vent chamber 7d, the more the fuel pressure of the vortex flow 9 falls. As a result, an amount of fuel discharged from the discharge hole 7a can be reduced.

In contrast, when the fuel is partly vaporized, the fuel in the pump passage 46 is not sufficiently increased in pressure. Accordingly, pressure difference between the vapor vent 6 and the control hole 6' is relatively small, and the main flow from the vent groove 7c is hardly affected by the control flow from the tangential groove 7b. In this condition, the combination of the main flow and the control flow constitutes a flow 9' flowing in a substantially radial direction as shown in FIG. 6, and the flow 9' including the fuel vapor can be discharged from the discharge hole 7a through the vent chamber 7d with a small resistance, resulting in easy discharge of the fuel vapor. It is understood that an amount of the fuel discharged from the discharge hole 7a depends upon section areas of the tangential groove 7b and the vent groove 7c and the fuel pressure difference between the tangential groove 7b and the vent groove 7c. In this embodiment, a section area of the tangential groove is taken to be smallest possible, so that a compact construction is obtained.

Figure 7:
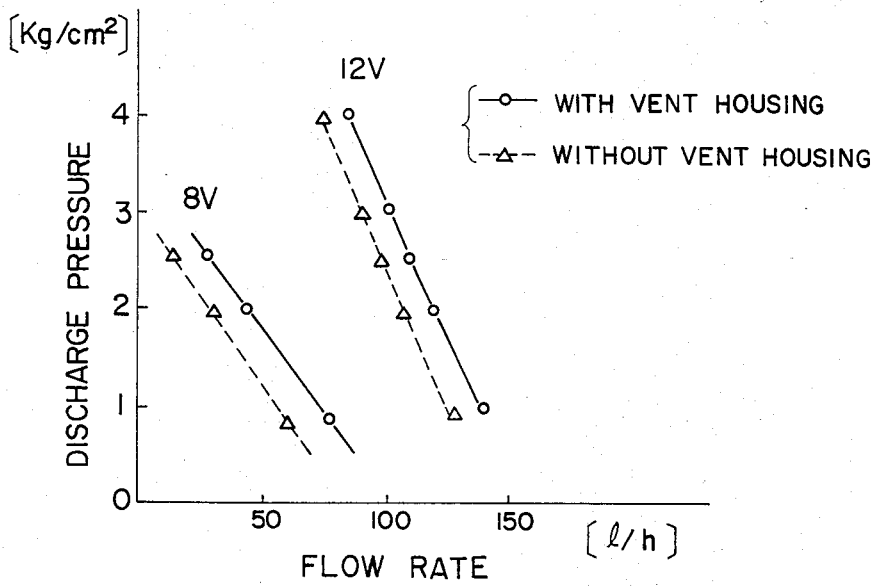
FIG. 7 shows characteristic curves of the fuel pump including the vent housing shown in FIG. 4.

Referring to FIG. 7, characteristic curves of the fuel pump are taken under conditions that input voltages of the motor of the fuel pump are 8 and 12 V. The abscissa indicates a flow rate of the fuel pump, and the ordinate indicates a discharge pressure of the fuel pump. The fuel pump including the vent housing allows the flow rate to be increased in the same discharge pressure as compared with the fuel pump including no vent housing. This advantage is enhanced in the condition of 8 V in input voltage, this condition corresponding to a starting condition in a low temperature. In addition, in an examination that the vapor-lock is compulsorily generated and thereafter a time required for re-starting the fuel pump is measured, it is found that the fuel pump including the vent housing gives a good performance.

Figure 8:
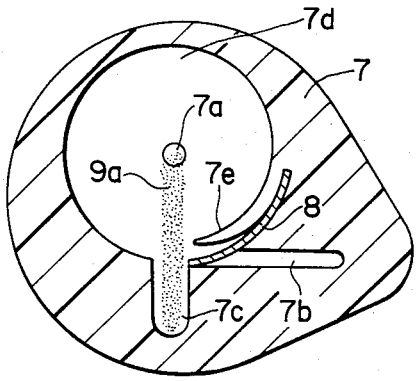
FIGS. 8 and 9 are enlarged views similar to FIGS. 5 and 6, showing a vent housing of another embodiment of the invention and also showing an operational principle of the invention.
Figure 9:
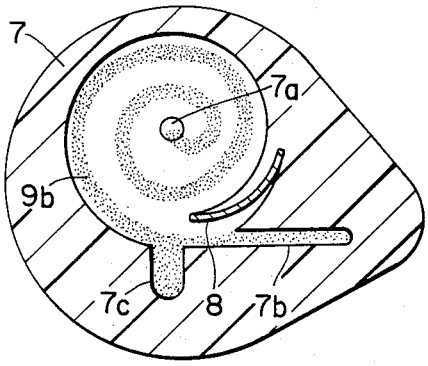

Referring to FIGS. 8 and 9, another embodiment of the invention includes a vent housing provided with a leaf spring at an outlet of the tangential groove. In FIG. 8, the vent housing 7 has a leaf spring 8 and a stopper 7e for the leaf spring 8. The stopper 7e has an inner surface smoothly connected to an inner surface of the vent chamber 7d, and a tip end projecting at the outlets of the vent groove 7c and the tangential groove 7d but so as not to close both of the grooves. The leaf spring 8 has a free end covering over the outlet of the tangential groove 7b. When the fuel vapor generates, the pressure in the tangential groove 7b is so low as not to overcome a spring force of the leaf spring 8, that is, the control flow from the tangential groove is not generated. Accordingly, only the main flow from the vent groove 7c exists in the vent chamber and the fuel vapor flows along a flow 9a in a radial direction or straight with no resistance, resulting in effective discharge of the fuel vapor to the outside of the fuel pump.

In contrast, when the fuel vapor does not generate, i.e. the vehicle is under a normal running, the pressure in the tangential groove 7b overcomes the spring force of the leaf spring 8 as shown in FIG. 9, so that the leaf spring 8 is pressed against an outer surface of the stopper 7e and the outlet of the tangential groove 7b is opened to the vent chamber 7d. The main flow from the vent groove 7c is altered in direction by the action of the control flow from the tangential groove 7b and becomes a vortex flow 9b. Accordingly, an amount of the fuel discharged from the discharge hole 7a can be reduced, like the case shown in FIG. 4.

Figure 10:
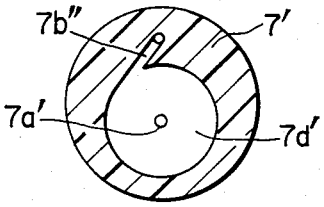
FIG. 10 is a view like FIG. 4 showing a vent housing of a further embodiment of the invention.

Another embodiment of the invention includes a vent housing provided with a tangential groove but no other groove. Referring to FIG. 10, the first casing portion 18 is provided with a vapor vent 6 but no control hole. The vent housing 7' has a vent chamber 7d' of a substantially circular shape, a tangential groove 7b'' provided with one end communicating with the vent chamber 7d' in the tangential direction to the vent chamber 7d' and other end communicating with the vapor vent 6, and a discharge hole 7a' provided with one end communicating with the center of the vent chamber 7d' and other end communicating with the outside of the fuel pump. When the fuel vapor is not generated, a vortex flow in the vent chamber 7d' is enhanced, and thus an amount of the fuel discharged from the discharge hole 7a' is reduced. When the fuel vapor is generated, a vortex flow becomes weaker, and thus an amount of the fuel discharged from the discharge hole *7a'* is increased.

Figure 11:
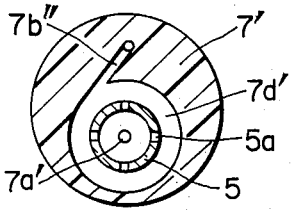
FIG. 11 is a view like FIG. 4, showing a vent housing of a still further embodiment of the invention.

FIG. 11 shows further another embodiment of the invention. The vent housing 7' includes a ring 5 provided with four communication holes 5a in the vent chamber *7d'*. The ring 5 is disposed to be concentric with the vent chamber *7d'*, and thus the vent chamber *7d'* is divided into two spaces. The two spaces communicate with each other through the communication holes 5a. In this embodiment, an amount of the fuel discharged from the discharge hole *7a'* is relatively reduced as compared with the embodiment shown in FIG. 10.

According to the invention, there is provided a fuel pump capable of effectively discharging the fuel vapor when the fuel vapor is generated and reducing discharge of the fuel from the vapor vent when the fuel vapor is not generated. Further, the fuel pump according to the invention realizes high reliability in addition to the above advantage because the vent housing has no movable part.

What is claimed is:

1. A fuel pump comprising a regenerative pump section, a driving section connected to an impeller of the regenerative pump section, and a housing enclosing the regenerative pump section and the driving section, the fuel pump being provided with a vapor vent midway of a pump passage extending from a suction port of the regenerative pump section to a discharge port thereof, wherein the vapor vent communicates with an outside of the fuel pump through a vent housing for a vortex flow, and the vent housing has a vent chamber of a substantially circular shape, a tangential groove provided with one end communicating with the vent chamber in a tangential direction to the vent chamber and other end communicating with the vapor vent, and a discharge hole provided with one end communicating with a center portion of the vent chamber and other end communicating with the outside of the fuel pump.

2. A fuel pump as claimed in claim 1, wherein the vent housing further has a ring provided with a plurality of communication holes and arranged to be concentric with the vent chamber so that the vent chamber is divided into two spaces, the two spaces communicating with each other through the communication holes.

3. A fuel pump comprising a regenerative pump section, a driving section connected to an impeller of the regenerative pump section, and a housing enclosing the regenerative pump section and the driving section, the fuel pump being provided with a vapor vent midway of a pump passage extending from a suction port of the regenerative pump section to a discharge port thereof, wherein the regenerative pump section is provided with a control hole communicating with the pump passage and disposed at a downstream side of the vapor vent, the vapor vent and the control hole communicate with an outside of the fuel pump through a vent housing, and the vent housing has a vent chamber of a substantially circular shape, a tangential groove provided with one end communicating with the vent chamber in a tangential direction to the vent chamber and other end communicating with the control hole, a vent groove provided with one end communicating with the vent chamber in a radial direction to the vent chamber and the other end communicating with the vapor vent, and a discharge hole provided with one end communicating with a center portion of the vent chamber and other end communicating with the outside of the fuel pump.

4. A fuel pump as claimed in claim 3, wherein the vent housing further has a leaf spring provided with one end secured to the vent housing and the other end covering over an outlet of the tangential groove, the other end of the leaf spring being capable of opening and closing the outlet of the tangential groove in response to a fuel pressure in the tangential groove.

5. A fuel pump as claimed in claim 4, wherein the vent housing further has a stopper having an inner surface smoothly connected to an inner surface of the vent chamber and a tip end projecting at outlets of the vent groove and the tangential groove but so as not to close both of the grooves, the leaf spring being pressed against the stopper when the leaf spring is in an opening state.

* * * * *